United States Patent [19]

Amos et al.

[11] Patent Number: 4,617,695

[45] Date of Patent: Oct. 21, 1986

[54] TOOTHBRUSH

[75] Inventors: Walter Amos, Wiesbaden; Horst Klein, Kelkheim-Fischbach, both of Fed. Rep. of Germany

[73] Assignee: Blendax-Werke R. Schneider GmbH & Co., Mainz, Fed. Rep. of Germany

[21] Appl. No.: 699,341

[22] Filed: Feb. 7, 1985

[30] Foreign Application Priority Data

Feb. 7, 1984 [DE] Fed. Rep. of Germany ..... 3404150

[51] Int. Cl.[4] ..... A46B 9/04

[52] U.S. Cl. ..... 15/195; 15/167 R

[58] Field of Search ..... 15/190–199

[56] References Cited

U.S. PATENT DOCUMENTS 81,718 9/1868 Wiesler ..... 15/196

FOREIGN PATENT DOCUMENTS 420005 1/1911 France ..... 15/196

5143 of 1911 United Kingdom ..... 15/190

*Primary Examiner*—Peter Feldman

*Attorney, Agent, or Firm*—Birch, Stewart, Kolasch & Birch

[57] ABSTRACT

A toothbrush having a brush handle and brush head is provided with a plurality of openings in the brush head for receiving therein bundles of bristles. Each of the plurality of openings is in the shape of a hexagon having parallel elongated sides and rounded opposing ends. The plurality of hexagonal openings are also of a substantially uniform depth to evenly receive the bristle bundles.

2 Claims, 1 Drawing Figure

TOOTHBRUSH

BACKGROUND OF THE INVENTION

1. Field of the Invention

The present invention relates to a toothbrush whose brush head is designed in such a way as to be more densely equipped with bristles compared to usual toothbrushes.

2. Description of Background Art

According to the present opinion of dental science, it is desirable to use toothbrushes having a bristle field equipped as densely as possible with bristles.

In case of these so-called "multi-tuft toothbrushes", the placement of the bristles and their fixation in the brush head normally is effected by holes which were drilled into the surface of the brush head or round holes which were injected during injection molding of the brush handle.

Conventionally only the fixation of a very limited number of bristle bundles is possible, since, due to technical reasons, a minimum distance must be kept between the plurality of single holes.

Swiss Pat. No. 623,279 already discloses the design of the holes of the brush head not as round but as angular holes, especially square or rectangular holes.

It is stated that this design should render it possible to increase the quantity of bristle bundles fixed in the brush head. However, effect of increasing the quantity of bristle bundles does not occur in reality. With a well-known "multi-tuft toothbrush" having normal round bristle holes being in public use, the proportion of the hole area to the surface area of the brush head is approx. 34%, and only a proportion of 25% of the hole area may be achieved by using the square shaped the surface area bristle holes according to the preferred embodiment of Swiss Pat. No. 623,279.

So the technical solution suggested according to the Swiss Patent does not lead to any advance.

SUMMARY OF THE INVENTION

It has now been found that the brush head of a toothbrush may be optimally provided with bristle bundles, when the holes in which the bristles are to be fixed show a honeycomb designed shape in the form of a hexagon with at least one pair of opposite edges being preferably rounded.

In this manner it is possible to increase the proportion of the hole area to the surface area within the brush head, i.e. from the area provided with bristle bundles compared to the area without those bundles, to more than 40% whereas by using the square form discussed in the above mentioned Swiss Patent only a proportion of approximately 25% could be achieved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Surprisingly, it has been found that the way of solution indicated in the Swiss Patent, i.e. to replace the round shape of the holes by an angular one, only works and leads to an advance if it is modified according to the present invention in the shape of a hexagon, preferably with rounded edges at the opposite edges of the elongated sides. In other words, a honeycombed shape is most advantageous in obtaining a high ratio of bristle area to surface area.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
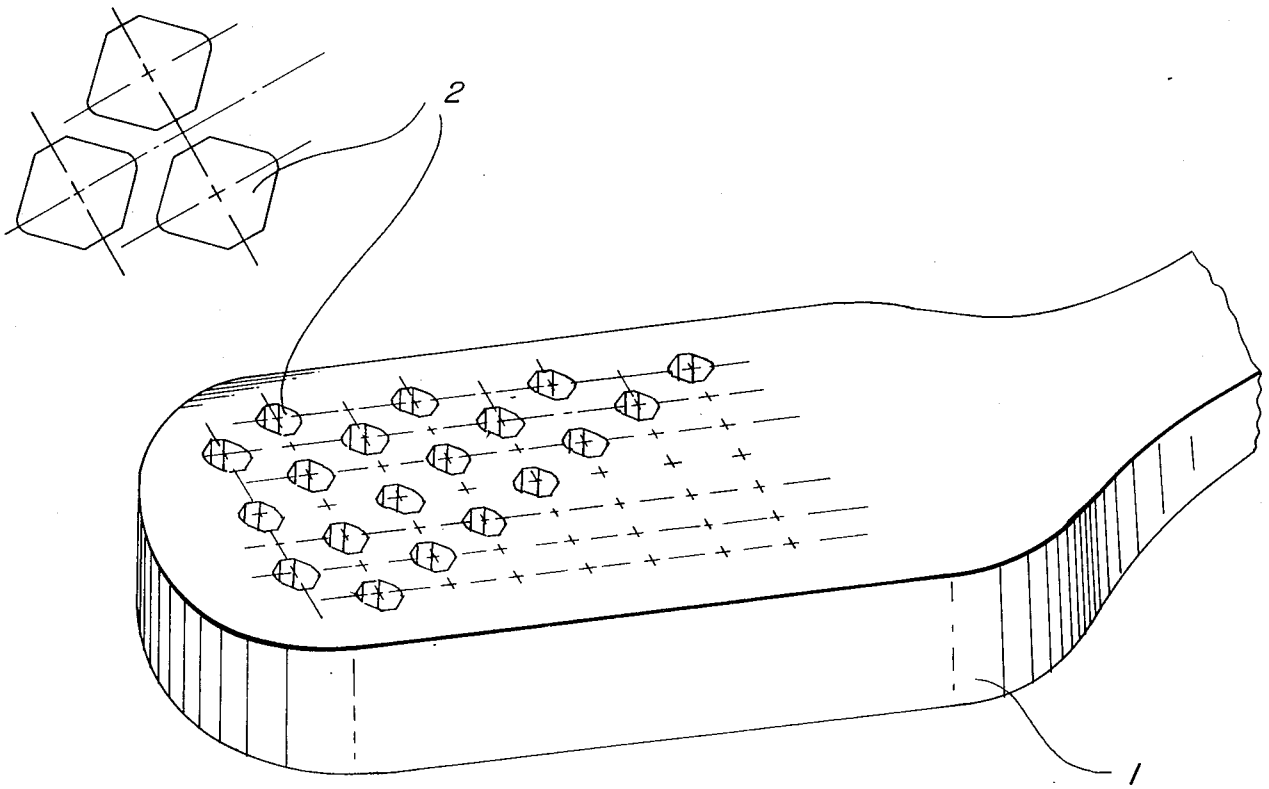
FIG. 1 is a plan view with a partial exploded top view illustrating the position and shape of the hexagonal openings in the surface of the toothbrush head.

FIG. 1 shows an exemplary embodiment of a bristle head (1) with the geometric shape of the bundle holes (2) to take up the bristle bundles according to the invention, thus achieving through this shape, contrary to the square and/or rectangular bundle holes known from the Swiss Patent, a considerably smaller hole distance and thus a better proportion of hole area to surface area with a constant number of holes.

The shape of the brush head according to the invention may be preferably used in normal manual toothbrushes, however, may also be applied for slip-on brushes for power-operated toothbrushes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toothbrush having a brush handle and a brush head with a flat surface area, said brush head being provided with a plurality of openings to receive bristle bundles therein, the improvement comprising:

a plurality of openings each in the shape of a hexagon having parallel elongated sides and rounded opposing ends;

said plurality of openings further being of a substantially uniform depth for receiving said bristle bundles.

2. A toothbrush according to claim 1, wherein the plurality of openings are such as to provide a ratio of bristle bundles to surface area of at least 40 percent.

* * * * *